US007857157B2

(12) United States Patent
Lane et al.

(10) Patent No.: US 7,857,157 B2
(45) Date of Patent: Dec. 28, 2010

(54) CONTAINER HAVING SEGMENTED BUMPER RIB

(75) Inventors: Michael T Lane, Brooklyn, MI (US); Mark O Blystone, Adrian, MI (US); G. David Lisch, Jackson, MI (US); Richard K Rangler, Tipton, MI (US)

(73) Assignee: Amcor Limited, Abbotsford, Victoria (AU)

( * ) Notice: Subject to any disclaimer, the term of this patent is extended or adjusted under 35 U.S.C. 154(b) by 1004 days.

(21) Appl. No.: 11/339,710

(22) Filed: Jan. 25, 2006

(65) Prior Publication Data

US 2007/0170144 A1 Jul. 26, 2007

(51) Int. Cl.
*B65D 90/02* (2006.01)
*B65D 90/22* (2006.01)

(52) U.S. Cl. ..... 215/383; 215/382; 215/384

(58) Field of Classification Search ..... 215/381–384
See application file for complete search history.

(56) References Cited

U.S. PATENT DOCUMENTS

| | | | | |
|---|---|---|---|---|
| D320,154 | S | 9/1991 | Alberghini et al. | |
| 5,060,453 | A | 10/1991 | Alberghini et al. | |
| 5,064,081 | A | 11/1991 | Hayashi et al. | |
| 5,067,622 | A | 11/1991 | Garver et al. | |
| 5,199,588 | A | 4/1993 | Hayashi | |
| 5,222,615 | A | 6/1993 | Ota et al. | |
| 5,224,614 | A * | 7/1993 | Bono et al. | 215/384 |
| 5,238,129 | A | 8/1993 | Ota | |
| 5,381,910 | A | 1/1995 | Sugiura et al. | |
| 5,749,075 | A * | 5/1998 | Toader et al. | 705/14.19 |
| 5,908,127 | A | 6/1999 | Weick et al. | |
| D421,721 | S * | 3/2000 | Guertin | D9/520 |
| 6,036,037 | A | 3/2000 | Scheffer et al. | |
| 6,044,997 | A | 4/2000 | Ogg | |
| 6,161,713 | A | 12/2000 | Krich | |
| 6,257,433 | B1 | 7/2001 | Ogg et al. | |
| D451,032 | S | 11/2001 | Iizuka et al. | |
| D451,033 | S | 11/2001 | Iizuka et al. | |
| D452,444 | S | 12/2001 | Iizuka et al. | |
| D459,234 | S | 6/2002 | Bourque et al. | |
| 6,398,052 | B1 * | 6/2002 | Cheng et al. | 215/384 |
| 6,467,639 | B2 * | 10/2002 | Mooney | 215/384 |
| 6,513,669 | B2 | 2/2003 | Ozawa et al. | |

(Continued)

FOREIGN PATENT DOCUMENTS

WO WO 2004/048060 6/2004

*Primary Examiner*—Anthony Stashick
*Assistant Examiner*—Niki M Eloshway
(74) *Attorney, Agent, or Firm*—Harness, Dickey & Pierce, P.L.C.

(57) ABSTRACT

A plastic container has an upper portion including a mouth defining an opening into the container. A shoulder region extends from the upper portion. A sidewall portion extends from the shoulder region to a base portion. The base portion closes off an end of the container. An upper bumper portion is defined at a transition between the shoulder region and the sidewall portion. The upper bumper portion includes an upper raised wall defining a maximum width of the container. The upper raised wall includes a recessed portion formed therein. A lower bumper portion is defined at a transition between the base portion and the sidewall portion. The lower bumper portion includes a lower raised wall defining the maximum width of the container. The lower raised wall includes a recessed portion formed therein.

21 Claims, 6 Drawing Sheets

U.S. PATENT DOCUMENTS

| | | | | |
|---|---|---|---|---|
| 6,575,321 | B2 | 6/2003 | Bourque et al. | |
| 6,662,960 | B2 | 12/2003 | Hong et al. | |
| 6,749,075 | B2 | 6/2004 | Bourque et al. | |
| 6,889,866 | B2 | 5/2005 | Gilliam et al. | |
| D528,427 | S * | 9/2006 | Sasaki et al. | D9/541 |
| 7,455,189 | B2 * | 11/2008 | Lane et al. | 215/381 |
| 2002/0056696 | A1 * | 5/2002 | Mooney | 215/384 |
| 2003/0075521 | A1 * | 4/2003 | Miura | 215/384 |
| 2003/0205550 | A1 * | 11/2003 | Prevot et al. | 215/384 |
| 2004/0129669 | A1 | 7/2004 | Kelley et al. | |
| 2004/0164045 | A1 | 8/2004 | Kelley | |
| 2004/0173565 | A1 * | 9/2004 | Semersky et al. | 215/382 |
| 2004/0195200 | A1 | 10/2004 | Bourque et al. | |
| 2005/0045645 | A1 | 3/2005 | Tsutsui et al. | |
| 2005/0252881 | A1 | 11/2005 | Zhang et al. | |
| 2006/0151425 | A1 * | 7/2006 | Kelley et al. | 215/381 |
| 2006/0175284 | A1 * | 8/2006 | Noll et al. | 215/382 |
| 2007/0039918 | A1 * | 2/2007 | Lane et al. | 215/381 |
| 2007/0045222 | A1 * | 3/2007 | Denner et al. | 215/382 |

* cited by examiner

CONTAINER HAVING SEGMENTED BUMPER RIB

TECHNICAL FIELD

This disclosure generally relates to plastic containers for retaining a commodity, and in particular a liquid commodity. More specifically, this disclosure relates to a plastic container having a shoulder region and a base region each defining segmented bumpers that allow for absorption of an impact force without buckling or creasing of the container.

BACKGROUND

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. Studies have indicated that the configuration and overall aesthetic appearance of a blow-molded plastic container can affect consumer purchasing decisions. For example, a dented, distorted or otherwise unaesthetically pleasing container may provide the reason for some consumers to purchase a different brand of product which is packaged in a more aesthetically pleasing fashion.

While a container in its as-designed configuration may provide an appealing appearance when it is initially removed from a blow-molding machine, many forces act subsequently on, and alter, the as-designed shape from the time it is blow-molded to the time it is placed on a store shelf. Plastic containers are particularly susceptible to distortion since they are continually being re-designed in an effort to reduce the amount of plastic required to make the container. While this strategy realizes a savings with respect to material costs, the reduction in the amount of plastic can decrease container rigidity and structural integrity.

Manufacturers currently supply PET containers for various liquid commodities, such as juice and isotonic beverages. Suppliers often fill these liquid products into the containers while the liquid product is at an elevated temperature, typically between 155° F.-205° F. (68° C.-96° C.) and usually at approximately 185° F. (85° C.). When packaged in this manner, the hot temperature of the liquid commodity sterilizes the container at the time of filling. The bottling industry refers to this process as hot filling, and the containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well.

For non-high acid content commodities, pasteurization and retort are the preferred sterilization processes. Pasteurization and retort both present an enormous challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 155° F.

(approximately 70° C.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-30%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-380 mm Hg less than atmospheric pressure (i.e., 759 mm Hg-380 mm Hg). If not controlled or otherwise accommodated, these vacuum pressures result in deformation of the container, which leads to either an aesthetically unacceptable container or one that is unstable. Hot-fillable plastic containers must provide sufficient flexure to compensate for the changes of pressure and temperature, while maintaining structural integrity and aesthetic appearance. Typically, the industry accommodates vacuum related pressures with sidewall structures or vacuum panels formed within the sidewall of the container. Such vacuum panels generally distort inwardly under vacuum pressures in a controlled manner to eliminate undesirable deformation.

While vacuum panels allow containers to withstand the rigors of a hot-fill procedure, the panels have limitations and drawbacks. First, vacuum panels formed within the sidewall of a container do not create a generally smooth glass-like appearance. Second, packagers often apply a wrap-around or sleeve label to the container over the vacuum panels. The appearance of these labels over the sidewall and vacuum panels is such that the label often becomes wrinkled and not smooth. Additionally, one grasping the container generally feels the vacuum panels beneath the label and often pushes the label into various panel crevasses and recesses.

External forces are applied to sealed containers as they are packaged and shipped. In some instances, adjacent containers bump into one another while traveling down a conveyor or during handling and shipping. In some examples, containers may define bumpers formed in the sidewall of the containers. Generally, the label area is recessed into the sidewall of the container resulting in outwardly oriented sections immediately above and below the recessed label area. These outwardly oriented sections are commonly referred to as bumpers. As such, bumpers typically form a raised land area defining an outermost dimension in cross section of the container.

The bumpers serve to protect the label from damage which may occur when two or more containers contact one another during handling, shipping and transporting. Traditionally, bumpers are strong, rigid structures designed to resist any distortion or denting when exposed to impact forces created by bottle-to-bottle contact or other external forces created during handling, shipping and transporting of the containers.

Such bumpers are designed to have the strength to withstand the rigors of bulk container filling, capping, labeling, transporting and distributing. However, excessive external impact forces may cause a bumper to collapse, thus losing its ability to provide label protection. Because bumpers are traditionally rigid structures, the collapse of a bumper often results in buckling, which causes permanent deformation in the form of permanent denting or creasing. This permanent deformation, in addition to failing to provide sufficient label protection, results in a container which is aesthetically undesirable to the consumer.

Bumpers may be adapted to absorb certain impact forces during packaging, shipping and transporting. In some cases, however, impact forces may cause the container to temporarily or permanently buckle or crease at the respective bumper.

Thus, there is a need for an improved lightweight container, which can accommodate vacuum pressures resulting from hot filling and absorb impact forces without buckling or creasing the container during packaging, handling and shipping.

SUMMARY

Accordingly, the present disclosure provides for a plastic container having an upper portion including a mouth defining an opening into the container. A shoulder region extends from the upper portion. A sidewall portion extends from the shoulder region to a base portion. The base portion closes off an end of the container. An upper bumper portion is defined at a transition between the shoulder region and the sidewall portion. The upper bumper portion includes a raised wall defining a maximum width of the container. The raised wall includes a recessed portion formed therein.

According to other features, a lower bumper portion is defined at a transition between the base portion and the sidewall portion. The lower bumper portion includes a raised wall defining the maximum width of the container. The raised wall includes a recessed portion formed therein.

Additional benefits and advantages of the present disclosure will become apparent to those skilled in the art to which the present disclosure relates from the subsequent description and the appended claims, taken in conjunction with the accompanying drawings.

DETAILED DESCRIPTION

The following description is merely exemplary in nature, and is in no way intended to limit the disclosure or its application or uses.

To accommodate vacuum related forces during cooling of the contents within a PET heat-set container, containers typically have a series of vacuum panels or pinch grips around their sidewall, and/or flexible grip areas. The vacuum panels, pinch grips and flexible grip areas all deform inwardly, to some extent, under the influence of vacuum related forces and prevent unwanted distortion elsewhere in the container. However, with vacuum panels and pinch grips, the container sidewall cannot be smooth or glass-like, an overlying label often becomes wrinkled and not smooth, and end users can feel the vacuum panels and pinch grips beneath the label when grasping and picking up the container. With flexible grip areas, the container may more easily slip from the consumer's hand and/or result in an overall insecure feel. Additionally, in somewhat larger lightweight containers, with the above features in place, the container sidewall does not possess the requisite structure to prevent sagging and general unwanted distortion.

The disclosed container provides an upper and lower bumper configuration each defining recessed portions formed in a raised sidewall of the container. As will be described, the recessed portions define a discontinuity in the respective bumpers in the raised sidewalls so as to provide flexible recessed portions in the shoulder portion and in the base portion of the container. These bumpers having a recessed portion or discontinuity in the respective raised sidewalls will be referred to herein as segmented bumpers. In this way, the segmented bumpers discourage temporary or permanent buckling or creasing of the container when subjected to an impact force.

Figure 1:
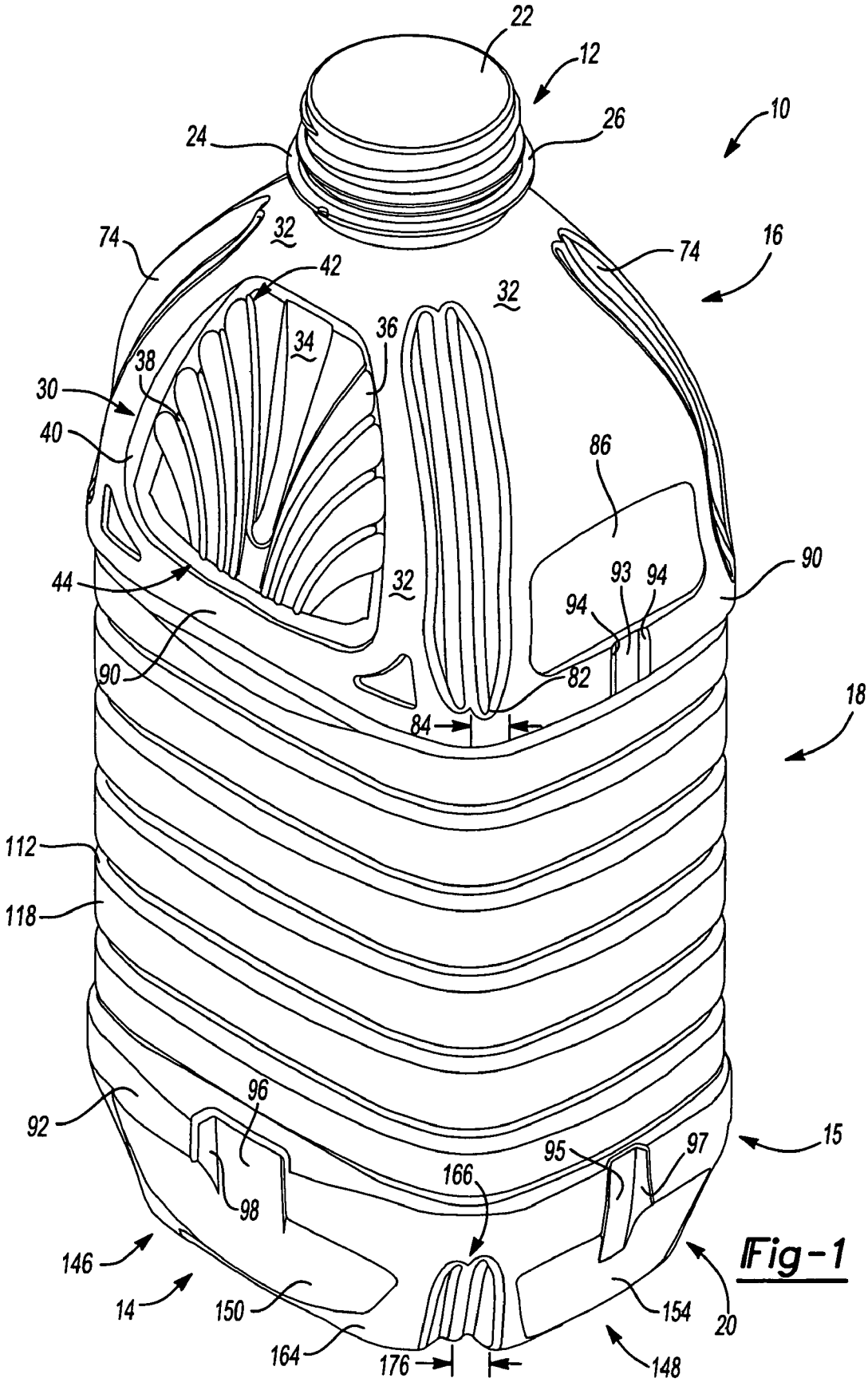
FIG. 1 is a perspective view of a plastic container constructed in accordance with the teachings of an embodiment of the present disclosure, the container as molded and empty.
Figure 2:
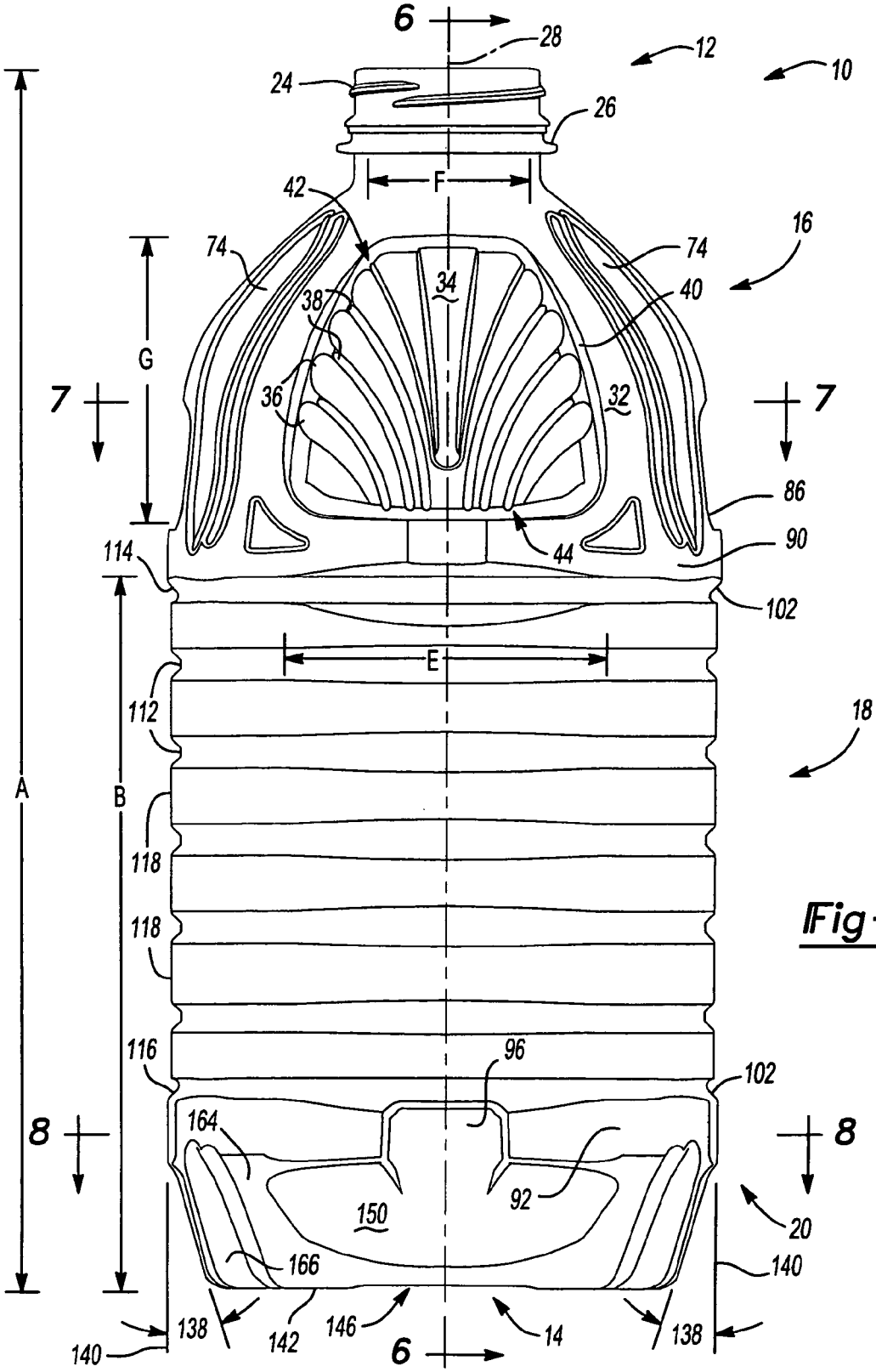
FIG. 2 is a front elevational view of the plastic container of FIG. 1, the container as molded and empty, the rear view thereof being identical thereto.
Figure 3:
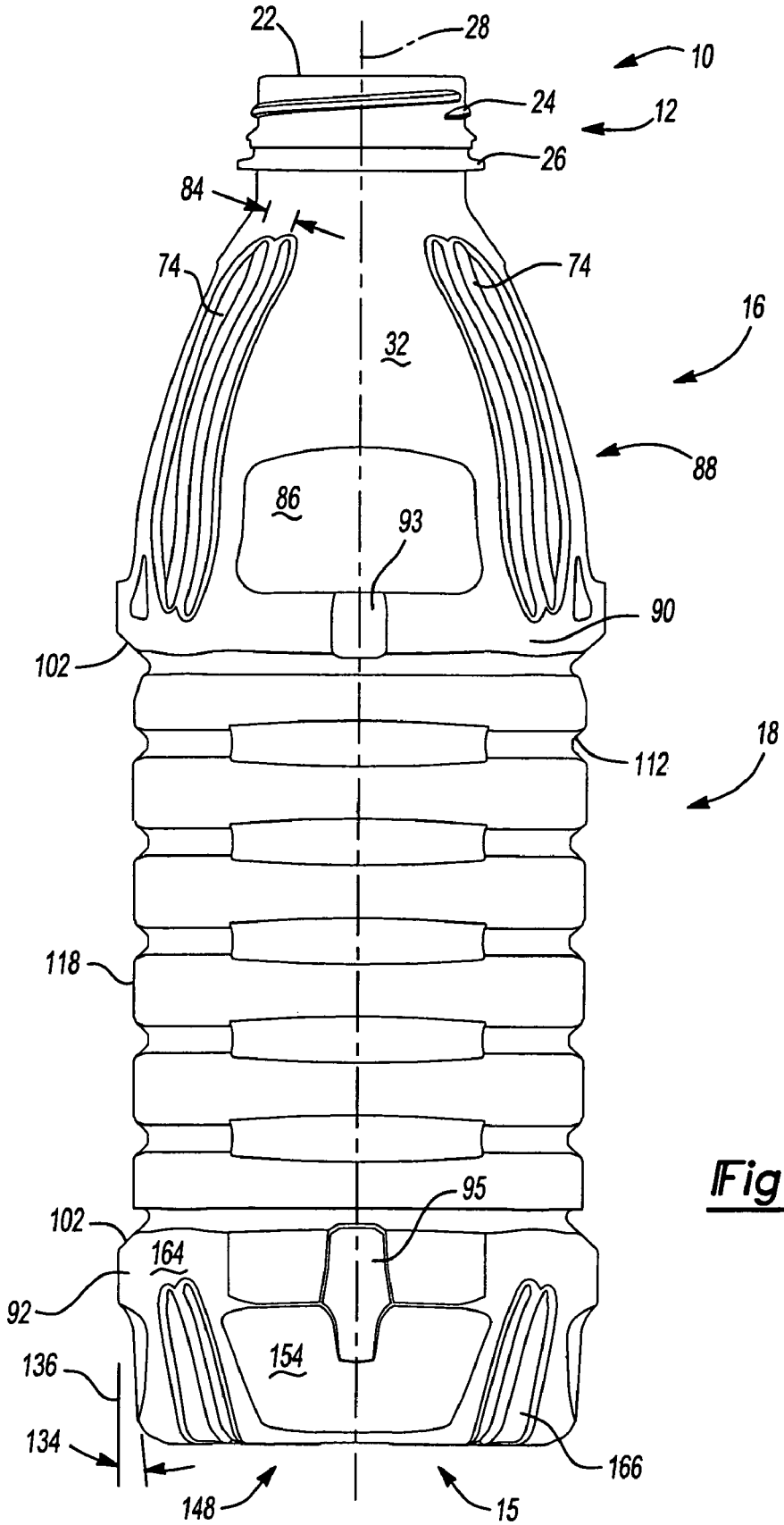
FIG. 3 is a right side view of the plastic container of FIG. 1, the container as molded and empty, the left side view thereof being identical thereto.
Figure 4:
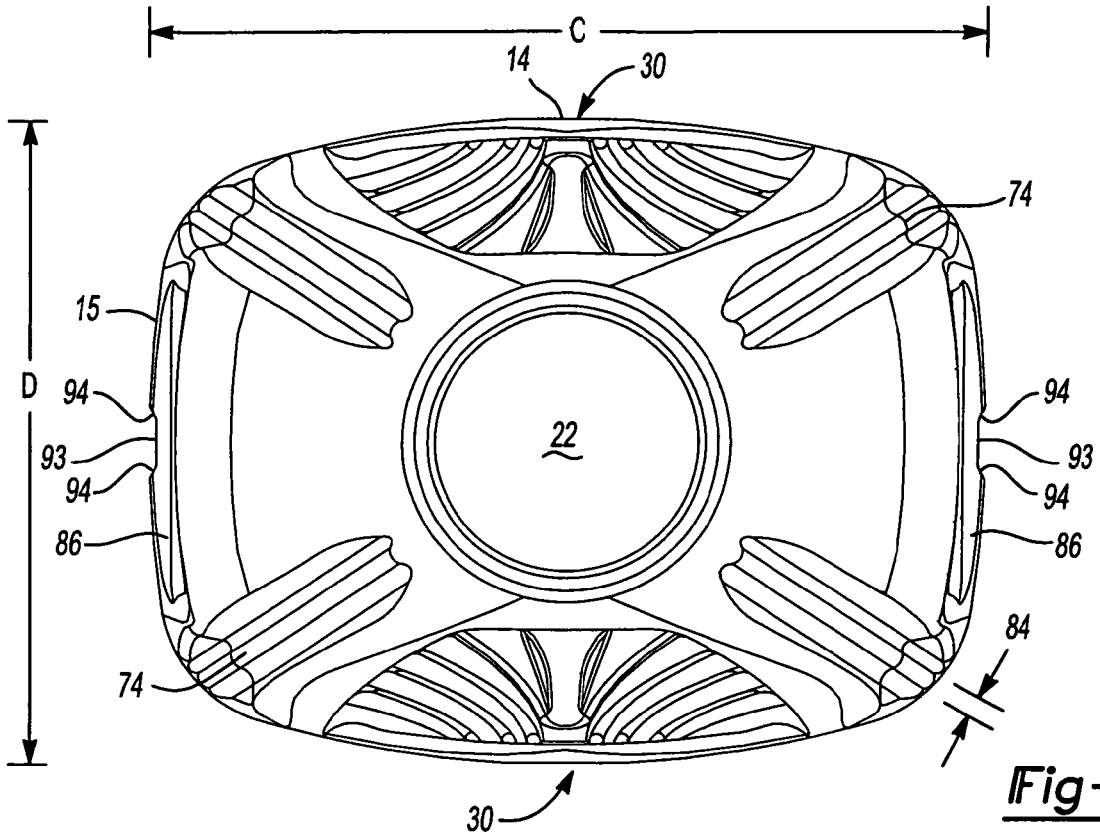
FIG. 4 is a top view of the plastic container of FIG. 1.
Figure 5:
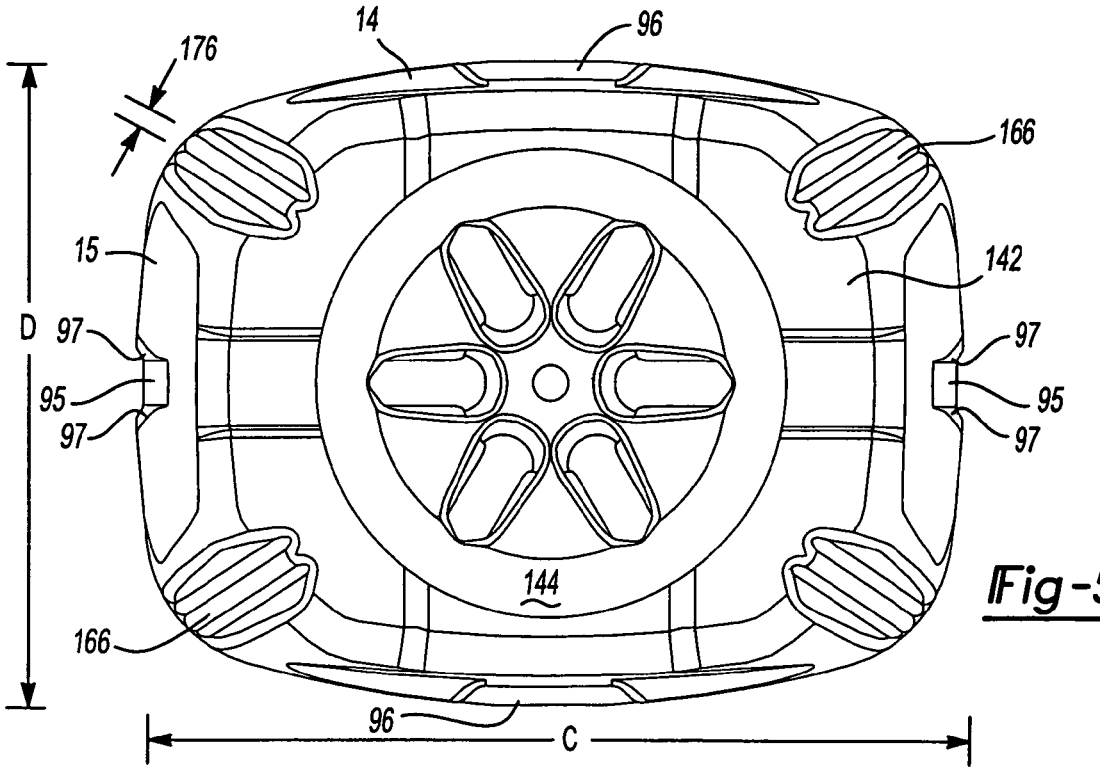
FIG. 5 is a bottom view of the plastic container of FIG. 1.

FIGS. 1-8 show one example of the present container. In the figures, reference number 10 designates a plastic, e.g. polyethylene terephthalate (PET), hot-fillable container. As shown in FIG. 2, the container 10 has an overall height A of about 10.45 inch (266.19 mm), and a sidewall and base portion height B of about 5.94 inch (151.37 mm). The height A is selected so that the container 10 fits on the shelves of a supermarket or store. As shown in FIGS. 4 and 5, the container 10 is substantially rectangular in cross sectional shape including opposing longer sides 14 each having a width C of about 4.72 inch (120 mm), and opposing shorter, parting line sides 15 each having a width D of about 3.68 inch (93.52 mm). The widths C and/or D are selected so that the container 10 can fit within the door shelf of a refrigerator. Said differently, as with typical prior art bottles, opposing longer sides 14 of the container 10 of the present disclosure are oriented at approximately 90 degree angles to the shorter, parting line sides 15 of the container 10 so as to form a generally rectangular cross section as shown in FIGS. 4 and 5. In this particular embodiment, the container 10 has a volume capacity of about 64 fl. oz. (1891 cc). Those of ordinary skill in the art would appreciate that the following teachings of the present disclosure are applicable to other containers, having other container shapes such as, for example but not limited to, round, oval or square shaped containers, which may have different dimensions and volume capacities. It is also contemplated that other modifications can be made depending on the specific application and environmental requirements.

As shown in FIGS. 1-3, the plastic container 10 of the disclosure includes a finish 12, a shoulder region 16, a sidewall portion 18 and a base 20. Those skilled in the art know and understand that a neck (not illustrated) may also be included having an extremely short height, that is, becoming a short extension from the finish 12, or an elongated height, extending between the finish 12 and the shoulder region 16. The plastic container 10 has been designed to retain a commodity during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a closure (not illustrated) before cooling. As the sealed container 10 cools, a slight vacuum, or negative pressure, forms inside causing the container 10, in particular, the shoulder region 16 to change shape. In addition, the plastic container 10 may be suitable for other high-temperature pasteurization or retort filling processes or other thermal processes as well.

The plastic container 10 of the present disclosure is a blow molded, biaxially oriented container with a unitary construction from a single or multi-layer material. A well-known stretch-molding, heat-setting process for making the hot-fillable plastic container 10 generally involves the manufacture of a preform (not illustrated) of a polyester material, such as polyethylene terephthalate (PET), having a shape well known to those skilled in the art similar to a test-tube with a generally cylindrical cross section and a length typically approximately fifty percent (50%) that of the container height. A machine (not illustrated) places the preform heated to a temperature between approximately 190° F. to 250° F. (approximately 88° C. to 121° C.) into a mold cavity (not illustrated) having a shape similar to the plastic container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container thereby molecularly orienting the polyester material in an axial direction generally corresponding with a central longitudinal axis 28 of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container. Typically, material within the finish 12 and a sub-portion of the base 20 are not substantially molecularly oriented. The pressurized air holds the mostly biaxial molecularly oriented polyester material against the mold cavity for a period of approximately two (2) to five (5) seconds before removal of the container from the mold cavity.

Alternatively, other manufacturing methods using other conventional materials including, for example, polyethylene naphthalate (PEN), a PET/PEN blend or copolymer, and various multilayer structures may be suitable for the manufacture of the plastic container 10. Those having ordinary skill in the art will readily know and understand plastic container manufacturing method alternatives.

The finish 12 of the plastic container 10 includes a portion defining an aperture or mouth 22, a threaded region 24, and a support ring 26. The aperture 22 allows the plastic container 10 to receive a commodity while the threaded region 24 provides a means for attachment of a similarly threaded closure or cap (not illustrated). Alternatives may include other suitable devices that engage the finish 12 of the plastic container 10. Accordingly, the closure or cap (not illustrated) engages the finish 12 to preferably provide a hermetical seal of the plastic container 10. The closure or cap (not illustrated) is preferably of a plastic or metal material conventional to the closure industry and suitable for subsequent thermal processing, including high temperature pasteurization and retort. The support ring 26 may be used to carry or orient the preform (the precursor to the plastic container 10) (not illustrated) through and at various stages of manufacture. For example, the preform may be carried by the support ring 26, the support ring 26 may be used to aid in positioning the preform in the mold, or an end consumer may use the support ring 26 to carry the plastic container 10 once manufactured.

Integrally formed with the finish 12 and extending downward therefrom is the shoulder region 16. The shoulder region 16 merges into and provides a transition between the finish 12 and the sidewall portion 18. The sidewall portion 18 extends downward from the shoulder region 16 to the base 20. The specific construction of the shoulder region 16 of the container 10 allows the sidewall portion 18 of the heat-set container 10 to not necessarily require additional vacuum panels or pinch grips and therefore, the sidewall portion 18 is capable of providing increased rigidity and structural support to the container 10. The specific construction of the shoulder region 16 allows for manufacture of a significantly lightweight container. Such a container 10 can exhibit at least a 10% reduction in weight from those of current stock containers. The base 20 functions to close off the bottom portion of the plastic container 10 and, together with the finish 12, the shoulder region 16, and the sidewall portion 18, to retain the commodity.

The plastic container 10 is preferably heat-set according to the above-mentioned process or other conventional heat-set processes. To accommodate vacuum forces while allowing for the omission of vacuum panels and pinch grips in the sidewall portion 18 of the container 10, the shoulder region 16 includes vacuum panels 30 formed therein. As illustrated in the figures, vacuum panels 30 are generally polygonal in shape and are formed in the opposing longer sides 14 of the container 10. Accordingly, the container 10 illustrated in the figures has two (2) vacuum panels 30. The inventors however equally contemplate that more than two (2) vacuum panels 30, such as four (4), can be provided. That is, that vacuum panels 30 may also be formed in opposing shorter, parting line sides 15 of the container 10 as well. Surrounding vacuum panels 30 is land 32. Land 32 provides structural support and rigidity to the shoulder region 16 of the container 10.

As illustrated in the figures, vacuum panels 30 of the container 10 include an underlying surface 34, a series of outwardly extending ribs 36, a series of inwardly extending ribs 38 and a perimeter wall or edge 40. Outwardly extending ribs 36 have an upper portion 42, and a lower portion 44. In one example, ribs 36 and 38 are generally arcuately shaped, arranged horizontally, and generally spaced equidistantly apart from one another. That is, the lower portion 44 of adjacent ribs 36 and 38 is closer to one another, while the upper portion 42 of adjacent ribs 36 and 38 is further apart from one another. This geometrical arrangement of ribs 36 and 38 directs vacuum forces to the strongest portion of vacuum panels 30. While the above-described geometry of ribs 36 and 38 is one example, a person of ordinary skill in the art will readily understand that other geometrical designs and arrangements are feasible. Such alternative geometrical designs and arrangements may increase the amount of absorption vacuum panels 30 can accommodate. Accordingly, the exact shape of ribs 38 can vary greatly depending on various design criteria.

The wall thickness of vacuum panels 30 must be thin enough to allow vacuum panels 30 to be flexible and function properly. Accordingly, the material thickness at the lower most point of ribs 36 and 38 is greater than the material thickness of the underlying surface 34. With this in mind, those skilled in the art of container manufacture realize that the wall thickness of the container 10 varies considerably depending where a technician takes a measurement within the container 10.

Vacuum panels 30 also include, and are surrounded by, the perimeter wall or edge 40. The perimeter wall or edge 40 defines the transition between the land 32 and the underlying surface 34 of vacuum panels 30, and is approximately 0.039 inch (1 mm) to approximately 0.236 inch (6 mm) in length. As is illustrated in the figures, the perimeter wall or edge 40 is shorter at the top and bottom portions of vacuum panels 30 and is longer at the right and left side portions of vacuum panels 30. Accordingly, the perimeter wall or edge 40 gradually declines toward the central longitudinal axis 28 of the container 10. One should note that the perimeter wall or edge 40 is a distinctly identifiable structure between the land 32 and the underlying surface 34 of vacuum panels 30. The perimeter wall or edge 40 provides strength to the transition between the land 32 and the underlying surface 34. The resulting localized strength increases the resistance to creasing and denting in the shoulder region 16.

Figure 6:
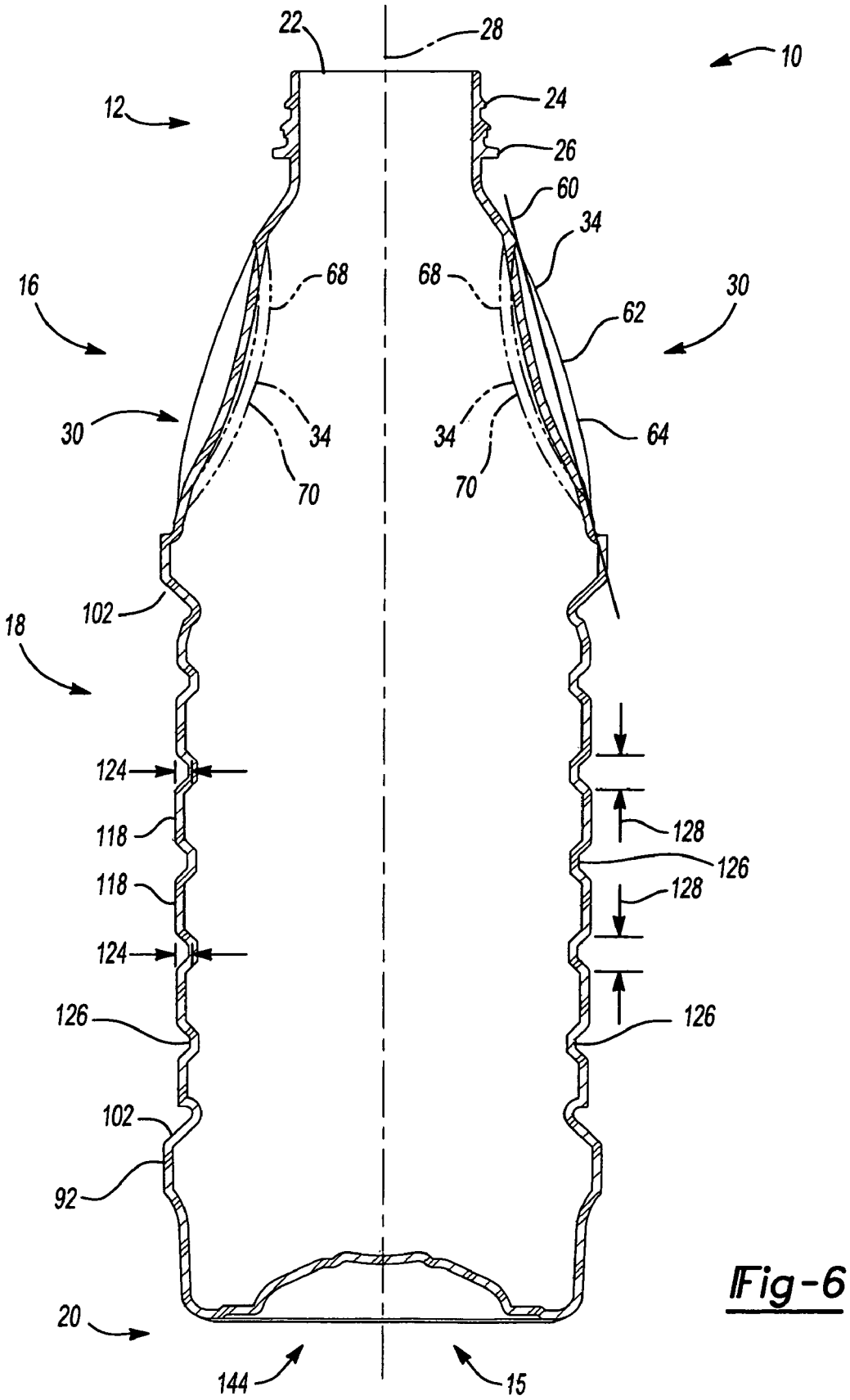
FIG. 6 is a cross-sectional view of the plastic container, taken generally along line 6-6 of FIG. 2.
Figure 7:
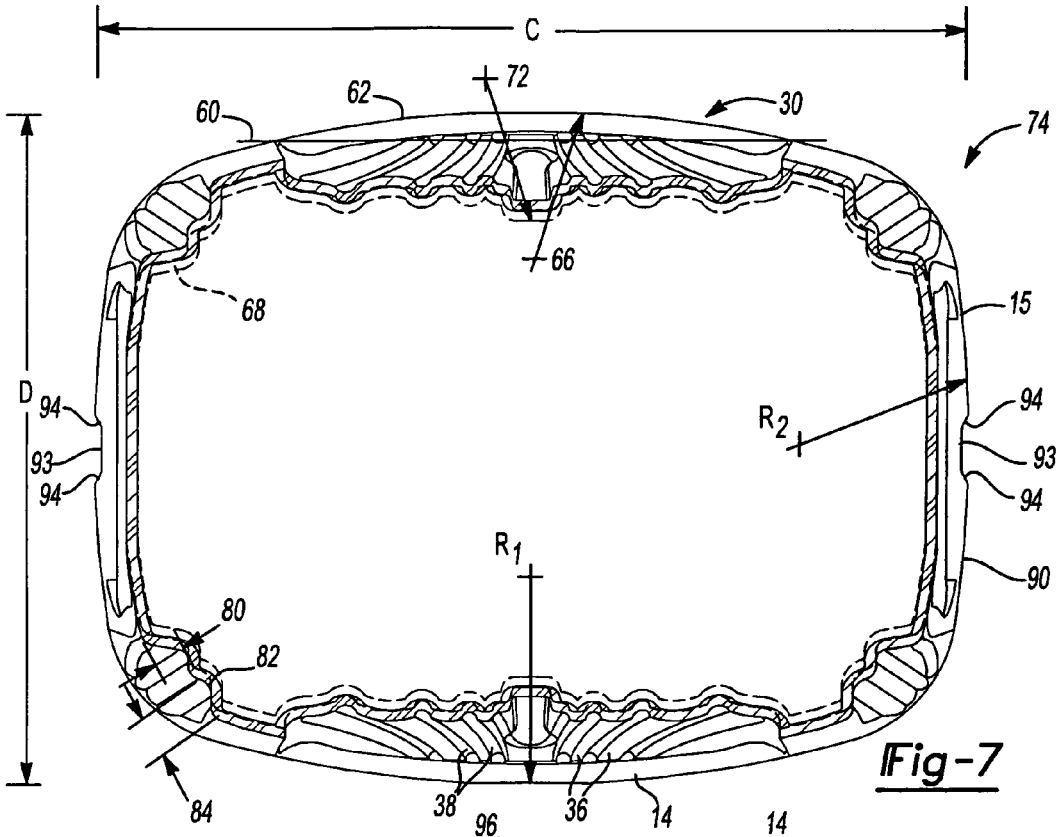
FIG. 7 is a cross-sectional view of the plastic container, taken generally along line 7-7 of FIG. 2.

As illustrated in FIG. 6, as molded, in cross section, the underlying surface 34 of vacuum panels 30 form a generally convex surface 62. An apex 64 of the convex surface 62 measures (for a typical container 10 having a nominal capacity of approximately 64 fl. oz. (1891 cc)) between approximately 0 inch (0 mm) and approximately 0.118 inch (3 mm) from a flat plane 60. As illustrated in the figures, flat plane 60 intersects a top portion and a bottom portion of the shoulder region 16 of the container 10. As illustrated in FIG. 7, as molded, in cross section, generally convex surface 62 of the underlying surface 34 has an underlying radius 66 suitable to establish a desired blending with the perimeter wall or edge 40.

Upon filling, capping, sealing and cooling, as illustrated in FIG. 6 in phantom, the perimeter wall or edge 40 acts as a hinge that aids in the allowance of the underlying surface 34 of vacuum panels 30 to be pulled radially inward, toward the central longitudinal axis 28 of the container 10, displacing volume, as a result of vacuum forces. In this position, the underlying surface 34 of vacuum panels 30, in cross section, illustrated in FIG. 6 in phantom, forms a generally concave surface 68. An apex 70 of the concave surface 68 measures (for a typical container 10 having a nominal capacity of approximately 64 fl. oz. (1891 cc)) between approximately 0 inch (0 mm) and approximately 0.118 inch (3 mm) from the flat plane 60. As illustrated in FIG. 7 in phantom, upon filling, capping, sealing and cooling, in cross section, generally concave surface 68 of the underlying surface 34 has an underlying radius 72 suitable to establish a desired blending with the perimeter wall or edge 40. The inventors anticipate that dimensions comparable to those set forth above are attainable for containers of varying shapes and sizes.

The greater the difference between the apex 64 and the apex 70, the greater the potential achievable displacement of volume. Said differently, the greater the inward radial movement between the apex 64 and the apex 70, the greater the achievable displacement of volume. The disclosure avoids deformation of the shoulder region 16, along with other portions of the container 10, by controlling and limiting the deformation to within vacuum panels 30. Accordingly, the thin, flexible geometry associated with vacuum panels 30 of the shoulder region 16 of the container 10 allows for greater volume displacement versus containers having a semi-rigid shoulder region.

The amount of volume which vacuum panels 30 of the shoulder region 16 displaces is also dependant on the projected surface area of vacuum panels 30 of the shoulder region 16 as compared to the projected total surface area of the shoulder region 16. In order to eliminate the necessity of providing vacuum panels or pinch grips in the sidewall portion 18 of the container 10, the projected surface area of vacuum panels 30 (two (2) vacuum panels) of the shoulder region 16 is required to be approximately 20%, and preferably greater than approximately 30%, of the total projected surface area of the shoulder region 16. The generally rectangular configuration of the container 10 creates a large surface area on opposing longer sides 14 of the shoulder region 16. The inventors have taken advantage of this large surface area by placing large vacuum panels 30 in this area. To maximize vacuum absorption, the contour of vacuum panels 30 substantially mimics the contour of the shoulder region 16. Accordingly, as illustrated in FIG. 2, this results in vacuum panels 30 having a bottom width E that is greater in length than a top width F. In one example, for the container 10 having a nominal capacity of approximately 64 fl. oz. (1891 cc), the width E is about 2.5 inch (63.5 mm) and the width F is about 1.25 inch (31.75 mm). In other words, the width E of vacuum panels 30 is approximately twice as long as the width F of vacuum panels 30. A height G of vacuum panels 30 is about 2.5 inch (63.5 mm), or said differently, is approximately 60% to approximately 80%, and more specifically approximately 70%, of a total height of the shoulder region 16. Thus, the configuration of the shoulder region 16 promotes the use of large vacuum panels. Said another way, each individual vacuum panel 30 formed in opposing longer sides 14 of the shoulder region 16 may cover approximately 8% to approximately 12%, and more specifically approximately 10%, of the overall area of the shoulder region 16 of the container 10.

As illustrated in FIGS. 1-4 and 7, between opposing longer sides 14 and opposing shorter, parting line sides 15 of the container 10, in the corners of the shoulder region 16, are formed modulating vertical ribs 74. Modulating vertical ribs 74 substantially follow the contour of the shoulder region 16 and extend vertically continuously almost the entire distance of the shoulder region 16, between the finish 12 and the sidewall portion 18. Surrounding modulating vertical ribs 74 are land 32. Similar to ribs 38, modulating vertical ribs 74 have an overall depth dimension 80 measured between a lowermost point 82 and the land 32. The overall depth dimension 80 is approximately equal to a width dimension 84 of modulating vertical ribs 74. Generally, the overall depth dimension 80 and the width dimension 84 for the container 10 having a nominal capacity of approximately 64 fl. oz. (1891 cc) is between approximately 0.039 inch (1 mm) and 0.157 inch (4 mm). As illustrated in the figures, modulating vertical ribs 74 are arranged between opposing longer sides 14 and opposing shorter, parting line sides 15 of the container 10, in the corners of the shoulder region 16, in pairs of two (2). While the above-described geometry of modulating vertical ribs 74 is one example, a person of ordinary skill in the art will readily understand that other geometrical designs and arrangements are feasible. Accordingly, the exact shape, number and orientation of modulating vertical ribs 74 can vary greatly depending on various design criteria.

In order to provide enhanced vacuum force absorption and accommodate top load forces, additional geometry is also included in opposing shorter, parting line sides 15 of the shoulder region 16 of the container 10. As illustrated in the figures, support panels 86 are formed in a lower portion 88 of opposing shorter, parting line sides 15 of the shoulder region 16. Support panels 86 are generally polygonal in shape and surrounded by land 32. Support panels 86 are centrally formed in the lower portion 88 of opposing shorter, parting line sides 15 of the shoulder region 16, and are parallel to the central longitudinal axis 28. The land 32 and support panels 86 provide additional structural support and rigidity to the shoulder region 16 of the container 10.

The unique construction of modulating vertical ribs 74, and support panels 86 add structure, support and strength to the shoulder region 16 of the container 10. This added structure and support, resulting from this unique construction, minimizes the outward movement or bowing, and denting of opposing shorter, parting line sides 15 of the shoulder region 16 of the container 10 during the fill, seal and cool down procedure. Thus, contrary to vacuum panels 30, modulating vertical ribs 74 and support panels 86 maintain their relative stiffness throughout the fill, seal and cool down procedure. The added structure and strength, resulting from the unique construction of modulating vertical ribs 74 and support panels 86, further aids in the transferring of top load forces thus aiding in preventing the shoulder region 16 of the container 10 from buckling, creasing, denting and deforming. Together, vacuum panels 30, modulating vertical ribs 74 and support panels 86 form a continuous integral rectangular shoulder region 16 of the container 10.

As illustrated in FIGS. 1-3, and briefly mentioned above, the sidewall portion 18 merges into and is unitarily connected to the shoulder region 16 and the base 20. The transition from the shoulder region 16 and the base 20 is represented by an upper bumper portion 90 and a lower bumper portion 92. The upper bumper portion 90 and the lower bumper portion 92 are defined, in part, by a peripheral ridge 102 formed in opposing longer sides 14 of the container 10. Each of the upper and lower bumper portions 90 and 92 generally define an upper and lower raised wall, respectively, extending around the horizontal perimeter of the container 10. As best illustrated in FIGS. 2 and 3, the upper and lower bumper portions 90 and 92 each define a maximum width of the container 10 on the longer sides 14 (FIG. 2) and on the shorter, parting line sides 15 (FIG. 3). With specific reference to FIGS. 7 and 8, the upper bumper portion 90 defines a radius $R_1$ at the opposing longer sides 14 and a radius $R_2$ at the shorter, parting line sides 15 of the container 10. The lower bumper portion 92 defines a radius $R_3$ at the opposing longer sides 14 and a radius $R_4$ at the shorter, parting line sides 15 of the container 10.

In one example, the upper bumper portion 90 defines a pair of opposing depressions or recessed portions 93 formed on the shorter, parting line sides 15 of the container 10. The recessed portions 93 may be defined through the central longitudinal axis 28 (FIG. 3). A transition between the recessed portions 93 and the outer wall of the upper bumper portion 90 is defined by tapered walls 94, as shown in FIGS. 1, 4 and 7. The recessed portions 93 may define a generally planar surface or may define a radius. It is also contemplated that recessed portions 93 may also be formed on the longer sides 14 of the container 10 as well.

Figure 8:
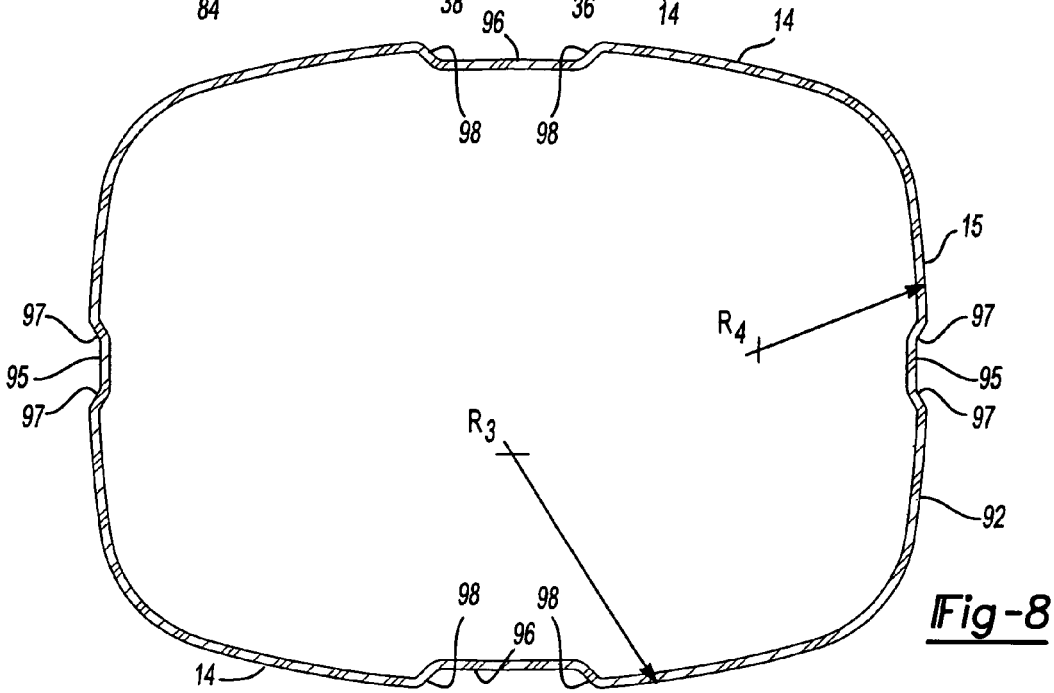
FIG. 8 is a cross-sectional view of the plastic container, taken generally along line 8-8 of FIG. 2.

The lower bumper portion 92 defines a first and second pair of opposing depressions or recessed portions 95 and 96, respectively. In one example, the recessed portions 95 and 96 may be defined through the central longitudinal axis 28 (FIGS. 2 and 3). A transition between recessed portions 95 and the outer wall of the lower bumper portion 92 is defined by tapered walls 97, as shown in FIGS. 1, 5 and 8. Similarly, a transition between recessed portions 96 and the outer wall of the lower bumper portion 92 is defined by tapered walls 98 as shown in FIGS. 1 and 8. The first and second pairs of recessed portions 95 and 96, respectively, may each define a generally planar surface or may define a radius. Recessed portions 93, 95 and 96 each provide flexible areas in their respective upper and lower bumper portions 90 and 92 which allow for and encourage temporary denting or buckling in these areas when subjected to an impact force. When the impact force is removed, the flexible areas associated with recessed portions 93, 95 and 96 allow the respective upper and lower bumper portions 90 and 92 to "rebound" back to their original position. Thus, serving to prevent any permanent creasing, denting or buckling in the upper and lower bumper portions 90 and 92 as a result of an impact force. Again, it is contemplated that additional recessed portions may be provided along the upper and/or lower bumper portions 90 and 92, such as, for example, on the upper bumper portion 90, below the vacuum panels 30.

The peripheral ridge 102 of the upper bumper portion 90 defines in part the transition between the shoulder region 16 and the sidewall portion 18, while the peripheral ridge 102 of the lower bumper portion 92 defines in part the transition between the base 20 and the sidewall portion 18. Accordingly, the peripheral ridge 102 of the upper bumper portion 90 and the peripheral ridge 102 of the lower bumper portion 92 are distinctly identifiable structures. In traditional containers, the above-mentioned transitions are generally designed to be abrupt in order to maximize the localized strength as well as form a geometrically rigid structure. The resulting localized strength increases the resistance to creasing, buckling, denting, bowing and sagging of the sidewall portion of such containers. However, this abrupt geometry is prone to permanent denting and buckling when exposed to significant impact forces. The container 10 includes recessed portions 93, 95 and 96 which prevent such permanent denting and buckling in their respective upper and lower bumper portions 90 and 92 due to impact forces. The peripheral ridge 102 is less abrupt and shorter in length in the area of the recessed portions 93, 95 and 96, thus aiding in enabling the recessed portions 93, 95 and 96 to allow for and encourage temporary denting or buckling in the upper and lower bumper portions 90 and 92 when subjected to impact forces, and subsequently allowing the respective upper and lower bumper portions 90 and 92 to "rebound" back to their original position when such impact forces are removed.

The sidewall portion 18 includes a series of horizontal ribs 112. Horizontal ribs 112 are uninterrupted and circumscribe the entire perimeter of the sidewall portion 18 of the container 10. Horizontal ribs 112 extend continuously in a longitudinal direction from the shoulder region 16 to the base 20. In this regard, the peripheral ridge 102 of the upper bumper portion 90 blends with and merges into a first horizontal rib 114 in the series of horizontal ribs 112, while the peripheral ridge 102 of the lower bumper portion 92 blends with and merges into a last horizontal rib 116 in the series of horizontal ribs 112. Defined between each adjacent horizontal rib 112 are lands 118. Lands 118 provide additional structural support and rigidity to the sidewall portion 18 of the container 10.

Similar to ribs 36 and 38, and modulating vertical ribs 74, horizontal ribs 112 have an overall depth dimension 124 (FIG. 6) measured between a lower most point 126 and lands 118. The overall depth dimension 124 is approximately equal to a width dimension 128 of horizontal ribs 112. Generally, the overall depth dimension 124 and the width dimension 128 for the container 10 having a nominal capacity of approximately 64 fl. oz. (1891 cc) is between approximately 0.039 inch (1 mm) and approximately 0.157 inch (4 mm). As illustrated in the figures, in one example, the overall depth dimension 124 and the width dimension 128 are fairly consistent among all of the horizontal ribs 112. However, in alternate examples, it is contemplated that the overall depth dimension 124 and the width dimension 128 of horizontal ribs 112 will vary between opposing sides or all sides of the container 10, thus forming a series of modulating horizontal ribs. While the above-described geometry of horizontal ribs 112 is one example, a person of ordinary skill in the art will readily understand that other geometrical designs and arrangements are feasible. Accordingly, the exact shape, number and orientation of horizontal ribs 112 can vary depending on various design criteria.

As is commonly known and understood by container manufacturers skilled in the art, a label may be applied to the sidewall portion 18 using methods that are well known to those skilled in the art, including shrink wrap labeling and adhesive methods. As applied, the label may extend around the entire body or be limited to a single side of the sidewall portion 18.

The unique construction of the sidewall portion 18 provides added structure, support and strength to the sidewall portion 18 of the container 10. This added structure, support and strength enhances the top load strength capabilities of the container 10 by aiding in transferring top load forces, thereby preventing creasing, buckling, denting and deforming of the container 10 when subjected to top load forces. Furthermore, this added structure, support and strength, resulting from the unique construction of the sidewall portion 18, minimizes the outward movement, bowing and sagging of the sidewall portion 18 during fill, seal and cool down procedure. Thus, contrary to vacuum panels 30 formed in the shoulder region 16, the sidewall portion 18 maintains its relative stiffness throughout the fill, seal and cool down procedure. Accordingly, the distance from the central longitudinal axis 28 of the container 10 to the sidewall portion 18 is fairly consistent throughout the entire longitudinal length of the sidewall portion 18 from the shoulder region 16 to the base 20, and this distance is generally maintained throughout the fill, seal and cool down procedure. Additionally, the lower bumper portion 92 of the sidewall portion 18 isolates the base 20 from any possible sidewall portion 18 movement and creates structure, thus aiding the base 20 in maintaining its shape after the container 10 is filled, sealed and cooled, increasing stability of the container 10, and minimizing rocking as the container 10 shrinks after initial removal from its mold.

The base 20 of the container 10 is tapered, extending inward from the sidewall portion 18. To this end, opposing longer sides 14 of the base 20 have an angle of divergence 134 (FIG. 3) from a vertical plane 136 corresponding to the sidewall portion 18 of approximately 8° to approximately 12°, while opposing shorter, parting line sides 15 of the base 20 have an angle of divergence 138 (FIG. 2) from a vertical plane 140 corresponding to the sidewall portion 18 of approximately 15° to approximately 20°. Accordingly, opposing shorter, parting line sides 15 of the base 20 will generally have a greater degree of taper than opposing longer sides 14 of the base 20. This improves ease of manufacture and results in more consistent material distribution in the base. Thus improving container stability and eliminating the need for a traditional non-round base push-up, which must be oriented in the mold.

As illustrated in FIG. 5, the base 20 is generally rectangular in shape, creating a generally octagonal footprint. The base 20 generally includes a contact surface 142 and a circular push up 144. The contact surface 142 is itself that portion of the base 20 that contacts a support surface that in turn supports the container 10. As such, the contact surface 142 may be a flat surface or line of contact generally circumscribing, continuously or intermittently, the base 20. In one example, as illustrated in FIG. 5, the contact surface 142 is a uniform, generally octagonal shaped surface that provides a greater area of contact with the support surface, thus promoting greater container stability. The circular push up 144 is generally centrally located in the base 20. Because the circular push up 144 is centrally located in the base 20, there is no need to further orient the container 10 in the mold. Thus promoting ease of manufacture.

The base 20 further includes support panels 146 formed in opposing longer sides 14 of the base 20 and support panels 148 formed in opposing shorter, parting line sides 15 of the base 20. Support panels 146 include a downwardly angled surface 150. Support panels 148 include a generally downwardly angled surface 154. Support panels 146 and 148 are surrounded by land 164.

In the corners of the base 20, between opposing longer sides 14 and opposing shorter, parting line sides 15, are formed modulating vertical ribs 166. Modulating vertical ribs 166 may be collinear with modulating vertical ribs 74 and substantially follow the contour of the base 20, extending vertically continuously almost the entire distance of the base 20, between the sidewall portion 18 and the contact surface 142 of the base 20. Modulating vertical ribs 166 are surrounded by land 164. Similar to modulating vertical ribs 74, modulating vertical ribs 166 have an overall depth dimension measured between a lower most point and land 164. The overall depth dimension is approximately equal to a width dimension 176 of modulating vertical ribs 166. Generally, similar to modulating vertical ribs 74, the overall depth dimension and the width dimension 176 of modulating vertical ribs 166 for the container 10 having a nominal capacity of approximately 64 fl. oz. (1891 cc) is between approximately 0.039 inch (1 mm) and approximately 0.157 inch (4 mm). Accordingly, similar to modulating vertical ribs 74, modulating vertical ribs 166 are arranged in pairs of two (2).

Therefore, support panels 146, modulating vertical ribs 166, support panels 148 and land 164 form a continuous integral generally tapered, rectangular in shape, having a generally octagonal footprint, base 20 of the container 10. While the above-described geometry and features of the base 20 are one example, a person of ordinary skill in the art will readily understand that other geometrical designs and arrangements are feasible. Accordingly, the exact shape and orientation of features of the base 20 can vary greatly depending on various design criteria.

The unique construction of support panels 146, support panels 148 and modulating vertical ribs 166 of the base 20, and the unique geometry of the base 20 adds structure, support and strength to the container 10. This unique construction and geometry of the base 20 enables inherently thicker walls providing better rigidity, lightweighting, manufacturing ease and material consistency. This added structure and support, resulting from this unique construction and geometry minimizes the outward movement or bowing of the base 20 during the fill, seal and cool down procedure. Thus, the base 20 maintains its relative stiffness throughout the fill, seal and cool down procedure. The added structure and strength, resulting from the unique construction and geometry of the base 20, further aids in the transferring of top load forces thus aiding in the prevention of the base 20 buckling, creasing, denting and deforming.

While the above description constitutes examples of the present disclosure, it will be appreciated that the disclosure is susceptible to modification, variation and change without departing from the proper scope and fair meaning of the accompanying claims.

What is claimed is:

1. A plastic container comprising:

an upper portion having a mouth defining an opening into said container;

a shoulder region extending from said upper portion;

a sidewall portion extending from said shoulder region to a base portion, said base portion closing off an end of said container; and an upper bumper portion defined at a transition from said shoulder region to said sidewall portion, said upper bumper portion having an upper raised wall defining a maximum width of the container, said upper raised wall further having a recessed portion formed therein bisecting said upper bumper portion and extending over an entire height of said upper raised wall from said shoulder region to an area of said sidewall portion immediately below said upper raised wall to generally prevent any permanent creasing, denting or buckling in said upper bumper portion as a result of an impact force.

2. The plastic container of claim 1 wherein said shoulder region comprises a generally rectangular horizontal cross section including two opposing longer sidewalls and two opposing shorter sidewalls.

3. The plastic container of claim 2 wherein said recessed portion is formed on at least one of said two opposing shorter sidewalls.

4. The plastic container of claim 3 wherein said recessed portion includes opposing recessed portions formed on each of said two opposing shorter sidewalls generally at a centerline of a longitudinal axis of said opposing shorter sidewalls.

5. The plastic container of claim 4 wherein said sidewall portion further comprises a series of uninterrupted horizontal ribs and a series of lands located between said horizontal ribs, said horizontal ribs and said lands circumscribing a perimeter of said sidewall portion and extending in a longitudinal direction from said shoulder region to said base region.

6. The plastic container of claim 4 wherein said opposing recessed portions each define tapered walls leading from said raised wall to said respective recessed portion.

7. The plastic container of claim 2 wherein said shoulder region includes two generally polygonal shaped vacuum panels, one formed in each of said opposing longer sidewalls of said shoulder region and two support panels, one formed in each of said opposing shorter sidewalls of said shoulder region.

8. The plastic container of claim 1, further comprising a lower bumper portion defined at a transition from said base portion to said sidewall portion, said lower bumper portion having a lower raised wall defined at said maximum width of the container, said lower raised wall further having a recessed portion formed therein.

9. A plastic container comprising:

an upper portion having a mouth defining an opening into said container;

a shoulder region extending from said upper portion, said shoulder region including a generally rectangular horizontal cross section including two opposing longer sidewalls and two opposing shorter sidewalls;

a sidewall portion extending from said shoulder region to a base portion, said sidewall portion further including a series of uninterrupted horizontal ribs and a series of lands located between said horizontal ribs, said horizontal ribs and said lands circumscribing a perimeter of said sidewall portion and extending in a longitudinal direction from said shoulder region to said base portion, said base portion closing off an end of the container; and an upper bumper portion defined at a transition from said shoulder region to said sidewall portion, said upper bumper portion having an upper raised wall defining a maximum width of the container, said upper raised wall further having at least two opposing recessed portions formed therein and each formed on a respective one of said two opposing shorter sidewalls generally at a centerline of a longitudinal axis of said opposing shorter sidewalls, said recessed portions bisecting said upper bumper portion and extending between said shoulder region and an area of said sidewall portion immediately below said upper raised wall to generally prevent any permanent creasing, denting or buckling in said upper bumper portion as a result of an impact force, a distance between said at least two opposing recessed portions being substantially equivalent to a distance between opposing portions of one of said lands on said opposing shorter sidewalls.

10. A plastic container comprising:

an upper portion having a mouth defining an opening into said container;

a shoulder region extending from said upper portion;

a sidewall portion extending from said shoulder region to a base portion, said base portion closing off an end of said container; and a lower bumper portion defined at a transition from said base portion to said sidewall portion, said lower bumper portion having a lower raised wall defining a maximum width of the container, said lower raised wall further having a recessed portion formed therein bisecting said lower bumper portion and extending over an entire height of said lower raised wall from said base portion to an area of said sidewall portion immediately above said lower raised wall to generally prevent any permanent creasing, denting or buckling in said lower bumper portion as a result of an impact force.

11. The plastic container of claim 10 wherein said base portion comprises a generally rectangular horizontal cross section including two opposing longer sidewalls and two opposing shorter sidewalls.

12. The plastic container of claim 11 wherein said recessed portion is formed on at least one of said opposing shorter and opposing longer sidewalls.

13. The plastic container of claim 12 wherein said recessed portion includes a first pair of opposing recessed portions formed on each of said two opposing shorter sidewalls respectively, said opposing recessed portions each formed generally at a longitudinal axis defined at a centerline of said opposing shorter sidewalls, respectively.

14. The plastic container of claim 13 wherein said sidewall portion further comprises a series of uninterrupted horizontal ribs and a series of lands located between said horizontal ribs, said horizontal ribs and said lands circumscribing a perimeter of said sidewall and extending in a longitudinal direction from said shoulder region to said base portion.

15. The plastic container of claim 14:

wherein a distance between said first pair of opposing recessed portions is substantially equivalent to a distance between opposing portions of one of said lands on said opposing shorter sidewalls.

16. The plastic container of claim 13 wherein said recessed portion further includes a second pair of opposing recessed portions formed on each of said two opposing longer sidewalls respectively, said opposing recessed portions each formed generally at a longitudinal axis defined at a centerline of said opposing longer sidewalls, respectively.

17. The plastic container of claim 16 wherein said sidewall portion further comprises a series of uninterrupted horizontal ribs and a series of lands located between said horizontal ribs, said horizontal ribs and said lands circumscribing a perimeter of said sidewall and extending in a longitudinal direction from said shoulder region to said base portion.

18. The plastic container of claim 17 wherein a distance between said second pair of recessed portions is substantially equivalent to a distance between opposing portions of one of said lands on said opposing longer sidewalls.

19. The plastic container of claim 18 wherein each of said first and second pair of recessed portions define tapered walls leading from said lower raised wall to said respective recessed portions.

20. A plastic container comprising:

an upper portion having a mouth defining an opening into said container;

a shoulder region extending from said upper portion;

a sidewall portion extending from said shoulder region to a base portion, said base portion closing off an end of the container;

an upper bumper portion defined at a transition from said shoulder region to said sidewall portion, said upper bumper portion having an upper raised wall defining a maximum width of the container, said upper raised wall further having a recessed portion formed therein bisecting said upper bumper portion and extending over an entire height of said upper raised wall from said shoulder region to an area of said sidewall portion immediately below said upper raised wall to generally prevent any permanent creasing, denting or buckling in said upper bumper portion as a result of an impact force; and a lower bumper portion defined at a transition from said base portion to said sidewall portion, said lower bumper portion having a lower raised wall defined at said maximum width of the container, said lower raised wall further having a recessed portion formed therein bisecting said lower bumper portion and extending over an entire height of said lower raised wall from said base portion to an area of said sidewall portion immediately above said lower raised wall to generally prevent any permanent creasing, denting or buckling in said lower bumper portion as a result of an impact force.

21. The plastic container of claim 20 wherein said shoulder region and said base portion comprise a generally rectangular horizontal cross section including two opposing longer sidewalls and two opposing shorter sidewalls, and wherein said recessed portion formed in said upper bumper portion is formed on at least one of said two opposing shorter sidewalls and said recessed portion formed in said lower bumper portion is formed on at least one of said opposing shorter and opposing longer sidewalls.

* * * * *